US008783437B2

(12) United States Patent
Simola et al.

(10) Patent No.: US 8,783,437 B2
(45) Date of Patent: Jul. 22, 2014

(54) CONTROL ARRANGEMENT FOR CONTROLLING A PEOPLE MOVER

(71) Applicant: Kone Corporation, Helsinki (FI)

(72) Inventors: Jyrki Simola, Helsinki (FI); Jyrki Vainio, Helsinki (FI); Teuvo Väntänen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/875,777

(22) Filed: May 2, 2013

(65) Prior Publication Data

US 2013/0233672 A1 Sep. 12, 2013

Related U.S. Application Data

(63) Continuation of application No. PCT/FI2011/050907, filed on Oct. 19, 2011.

(30) Foreign Application Priority Data

Nov. 2, 2010 (FI) ..... 20106147

(51) Int. Cl.
*B66B 25/00* (2006.01)

(52) U.S. Cl.
USPC ..... 198/322

(58) Field of Classification Search
USPC ..... 198/322, 324
See application file for complete search history.

(56) References Cited

U.S. PATENT DOCUMENTS 1,985,563 A * 12/1934 Fitz Gerald ..... 198/322
5,564,550 A * 10/1996 van Rooy et al. ..... 198/322
5,782,330 A * 7/1998 Mehlert et al. ..... 198/324
5,842,554 A * 12/1998 Stoxen et al. ..... 198/322
5,923,005 A * 7/1999 Blondiau et al. ..... 187/392
6,049,189 A * 4/2000 Markus et al. ..... 318/802
6,334,522 B2 * 1/2002 Haruta et al. ..... 198/322
6,988,607 B2 * 1/2006 Blondiau et al. ..... 198/322

(Continued)

FOREIGN PATENT DOCUMENTS

EP 0703183 A2 3/1996
JP 6100279 A 4/1994

(Continued)

OTHER PUBLICATIONS

International Search Report of PCT/IF2011/050907 and Written Opinion of the ISR dated Feb. 16, 2012.

(Continued)

*Primary Examiner* — Leslie A Nicholson, III
*Assistant Examiner* — Keith R Campbell
(74) *Attorney, Agent, or Firm* — Venable LLP; Robert Kinberg

(57) ABSTRACT

A control arrangement is provided for controlling a people mover. The people mover includes a movable conveyor track for transporting people and a control unit. The conveyor track is arranged to move at a first speed when transporting passengers. The control unit is arranged to detect passengers of the people mover with a passenger detection device and to measure the time passed since the last detection of a passenger. After the measured time has reached a set value of a delay time, the control unit operates to decrease the speed of the conveyor track of the people mover either to a lower second speed or to completely stop the movement. The set value of the delay time can be changed by an action of the control unit.

17 Claims, 2 Drawing Sheets

(56) References Cited

U.S. PATENT DOCUMENTS

| | | | | |
|---|---|---|---|---|
| 8,412,373 | B2 * | 4/2013 | Kangas et al. | 700/230 |
| 2012/0090922 | A1 * | 4/2012 | Elomaa et al. | 187/247 |
| 2012/0116574 | A1 * | 5/2012 | Kangas et al. | 700/230 |
| 2012/0247919 | A1 * | 10/2012 | Soldner et al. | 198/322 |

FOREIGN PATENT DOCUMENTS

| | | | | | |
|---|---|---|---|---|---|
| JP | 2004010259 | A | | 1/2004 | |
| JP | 2004224548 | A | * | 8/2004 | B66B 25/00 |
| JP | 2004224548 | A | | 8/2004 | |
| JP | 2006143450 | A | | 6/2006 | |
| KR | 20010056078 | A | | 7/2001 | |

OTHER PUBLICATIONS

Finnish Search Report of FI 20106147 dated Aug. 22, 2011 with English translation.

* cited by examiner

CONTROL ARRANGEMENT FOR CONTROLLING A PEOPLE MOVER

CROSS-REFERENCE TO RELATED APPLICATIONS

This application is a continuation of International Application No. PCT/FI2011/050907, filed Oct. 19, 2011, claiming priority to application Ser. No. 20/106,147, filed in Finland on Nov. 2, 2010, the contents of both applications being incorporated herein by reference in their entireties.

FIELD OF THE INVENTION

The invention relates to a control arrangement for controlling a people mover, which people mover is a travelator, an escalator or a moving ramp.

BACKGROUND OF THE INVENTION

The conveyor track in escalators is moved depending on the usage need. So-called standby operation is used for this purpose. If passengers do not come to an escalator, a photoelectric cell or a corresponding sensor does not give a signal, and the speed of the conveyor track is decreased from the rated speed (e.g. 0.65 m/s) after a delay time (e.g. 1 min) to creeping speed (typically 0.2 m/s) and further after a certain delay time (e.g. 5 min), the conveyor track stops. Always when a passenger arrives at the escalator, the control of the escalator increases the speed to the rated speed and the operating chain starts from the beginning. If the delay times of the stand-by function are set reasonably, the function saves energy, the service life of the escalator lengthens and the servicing need decreases. In most applications the use varies e.g. according to the times of day. A problem has been that e.g. on staircases traveling upwards from the platform level of a metro during peak hours it is almost certain that passengers will come very soon after a decrease of speed. In this case the decrease of speed would not, therefore, be necessary. Correspondingly, during very quiet times of day a staircase has been kept running for the amount of the delay time, although the probability of a next passenger arriving is low. A result of these is a large amount of stops, starts or unnecessary instances of being kept running, which has shortened the service life of the conveyor, increased energy consumption and shortened servicing intervals. The delay times have been set to be of certain lengths, and left permanently at those lengths. The set values of a delay time are not normally changed after commissioning, but if the value needs to be rectified, a serviceman must stop the conveyor and shift to the control panel to manually rectify the set value.

Known in the art are solutions wherein a travelator is self-learning or it is otherwise controlled based on historical data. For example, in a solution known from patent publication JP2004224548A, starting and stopping can be performed according to the arrival of a train at a station or the departure of a train from a station. In these solutions the speed of the escalator has thus been changed on other bases than the delay time that has passed since the last user. If a measurement of the delay time from the last passenger were used concurrently in the types of escalators referred to above, for changing the speed on the basis of the delay time, the delay time in these solutions would also be constant in the manner of prior art. In these respects, therefore, the avoidance of unnecessary changes of speed during operation is still ineffective.

AIM OF THE INVENTION

The aim of the invention is to eliminate, among others, the aforementioned drawbacks of prior-art solutions. More particularly, the aim of the invention is to achieve a simple people mover having a low number of unnecessary speed changes. Further, the aim is to achieve a people mover with which the need to keep it running unnecessarily can be avoided.

SUMMARY OF THE INVENTION

The invention is based on the concept that by changing the length of a delay time by an action of a control of a people mover to be well suited to a prevailing situation, unnecessary speed changes and running can be reduced. A large set value can be modified for the delay time at points of time when congestion is predicted or detected, and a small set value at times when it is predicted or detected to be quiet. Prediction can be performed e.g. based on timetables of nearby public service vehicles or from a signal of a public service vehicle arriving nearby or based on historical data. Detection can be used e.g. such that the operator of a people mover, e.g. from a control room, gives a command to the control based on his/her detections to change the set value of the delay time to be suitable.

In one basic embodiment of the concept according to the invention, a control arrangement for controlling a people mover, such as a travelator, an escalator or a moving ramp, that includes a movable conveyor track for transporting people on the conveyor track, comprises a control unit and a passenger detection device, which control unit is arranged to detect passengers of the people mover with the passenger detection device, and to measure the time during which a passenger is not detected, and after the measured time has reached a set value of the delay time, i.e. without a passenger being detected with the aforementioned detection device, to decrease the speed of the conveyor track of the people mover from a first speed either to a lower second speed or to completely stop the movement. The set value of the delay time can be changed by an action of the control unit. In this way the aforementioned advantages are achieved.

In another embodiment of the invention the first speed is the transport speed of passengers, which speed the people mover has when passengers are traveling on it.

In a further embodiment of the invention the control unit is arranged to measure the time during which a passenger is not detected, by measuring the time passed since the last detection of a passenger with a time measuring device. The passenger to be detected is may be a passenger who is coming to the people mover in question but alternatively, or additionally, the passenger to be detected can be a passenger who is being transported by the people mover or a passenger leaving the people mover.

In a more refined embodiment of the invention the set value of the delay time can be changed without removing the people mover from normal drive. In this way the people mover can continue its operation normally without disturbance regardless of a changing of the set value. A set value can preferably be changed despite possible movement of the conveyor track.

In another embodiment of the invention the set value of the delay time is, at a busy point of time, for example in the daytime, greater than at a quiet point of time, for example at nighttime.

In yet another embodiment of the invention the control unit is arranged to change the set value of the delay time on the basis of a point of time and/or on the basis of a signal coming from outside the people mover.

In a further embodiment of the invention the arrangement, more particularly the control unit of same, comprises a determination device for a point of time.

In a more refined embodiment of the invention the control unit comprises a memory, in which set values of different magnitudes for (different) points of time are recorded. These set values may be of at least two different magnitudes, for example more than two.

In another embodiment of the invention the control unit is arranged to itself record in memory the set values of the delay time for points of time based on historical data, for example based at least on the historical data of the detections of the passenger detection device and also based on signals coming from outside.

In a further embodiment of the invention the control unit is arranged to change the set value of the delay time to be according to the set value recorded for the current point of time.

In another embodiment of the invention set values specific to the time of day are recorded in the memory. These set values may be of at least two different magnitudes, for example more than two.

In yet another embodiment of the invention the determination device for the point of time comprise a clock.

In a further embodiment of the invention set values of different magnitudes for points of time are recorded in the memory, the set values being based on timetables of public service vehicles that are in the proximity of the people mover.

In another embodiment of the invention the first speed is a constant speed. In other words, the first speed is a speed that is kept the same at least for a certain time.

In a further embodiment of the invention the aforementioned second speed is a constant speed. In other words, the second speed is a speed that is kept the same at least for a certain time.

In another embodiment of the invention the delay time of the first and/or second speed decrease step of the people mover can be changed in the manner described above. It is possible that two set values of the delay time of the people mover can be changed in the aforementioned manner by an action of the control unit.

In another embodiment of the invention the control unit is arranged to change the set value of the delay time on the basis of a point of time, more precisely on the basis of the time of day.

In a further embodiment of the invention set values specific to the time of day are recorded/can be recorded in the memory for specific individual weekdays or calendar days.

In a modified embodiment of the invention the clock time is at least the time of a clock expressing the time of day, which clock may be a clock that counts a 24-hour cycle or a multiple of it, in which case the cycle is for example 168 hours.

In another embodiment of the invention the control unit is arranged to change the set value of the delay time on the basis of a signal caused by a public service vehicle that is in proximity of the people mover.

In a further embodiment of the invention the control unit is arranged to change the delay time to be longer on the basis of a signal of a public service vehicle arriving in proximity of the people mover.

In another embodiment of the invention if the speed of the conveyor track has earlier been decreased, the arrangement is arranged to increase the speed when a passenger is detected with the aforementioned detection device.

In a modified embodiment of the invention when a passenger is detected with the detection device, the time during which a passenger is not detected starts to be counted from a fresh start.

In a more refined embodiment of the invention the control unit comprises an input for a signal external to the people mover.

In another embodiment of the invention the control unit comprises a memory, in which set values are recorded, and that the control unit is arranged to select from these the set value of the delay time on the basis of the aforementioned signal.

In a further embodiment of the invention the arrangement comprises an interface for sending a signal to an input of the control unit.

In a modified embodiment of the invention the interface for sending a signal to the control unit comprises a user interface in the control room of the people mover.

In a further embodiment of the invention, connected to the input is an apparatus for determining the position or information connected to the position of a public service vehicle, for example of a train, that is in proximity of the people mover, for example for detecting a sensor at a station of the aforementioned public service vehicle (for detecting the arrival, presence at the station or departure of the train), or for receiving position data, or data connected to the position, of the public service vehicle of a data transfer channel connected to a system of a station of the aforementioned public service vehicle, from the system of a station of the public service vehicle.

In a further embodiment of the invention when the speed of the conveyor track of the people mover has been decreased to a lower second speed, the speed is kept constant. If passengers are not detected the speed is kept constant at least for a certain time, for example for the amount of time according to the set value of the second delay time, which may be at least 30 seconds, more preferably at least 1 minute. After this the speed is again decreased, or the conveyor track may be stopped. If, when driving at the second speed, which is a constant speed, a passenger is detected, the speed is increased back to the first speed.

In a modified embodiment of the invention the first speed is the rated speed of the people mover, for example at least 0.5 m/s, and the second speed is some constant speed between 0.1-0.3 m/s.

In another embodiment of the invention the control unit is arranged to choose whether to decrease the speed of the conveyor track from a first speed to a lower second speed or whether to completely stop the movement of the conveyor track on the basis of a point of time and/or on the basis of a signal coming from outside the people mover. The additional features of this embodiment can form an invention regardless of whether the delay time is changeable. One advantage is that during a quiet time, for example at nighttime, the conveyor can be stopped directly and at a busier time, for example in the daytime, the speed of the conveyor can be decreased to a second lower speed after the delay time has reached the set value of the delay time. A complete halt during a busier time may be unnecessary, so first the speed is decreased to a second lower speed, at which second lower speed the people mover is kept constant at least for a certain time.

In yet another embodiment of the invention the control arrangement comprises at least one second people mover, which is a travelator, an escalator or a moving ramp, the conveyor track of which people mover is arranged to move at a first speed when transporting passengers, and that the control unit may be arranged to detect passengers of the aforementioned second people mover with a second passenger detection device, and to measure the time during which a passenger is not detected, e.g. the time passed since the last detection of a passenger of the second people mover, with a time measuring device, and after the measured time has reached the set value of the delay time of the second people mover, to decrease the speed of the conveyor track of the second people mover either to a lower second speed or to completely stop the movement, which set value of the delay time of the second people mover can be changed by an action of the control unit. The control unit may control the second people mover in the same way as the first.

In another embodiment of the invention set values for points of time are recorded in the memory comprised in the control, said set values being specific to the people mover.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. The additional features mentioned by each preceding embodiment can also singly and separately from the other embodiments form a separate invention.

DETAILED DESCRIPTION

Figure 1:
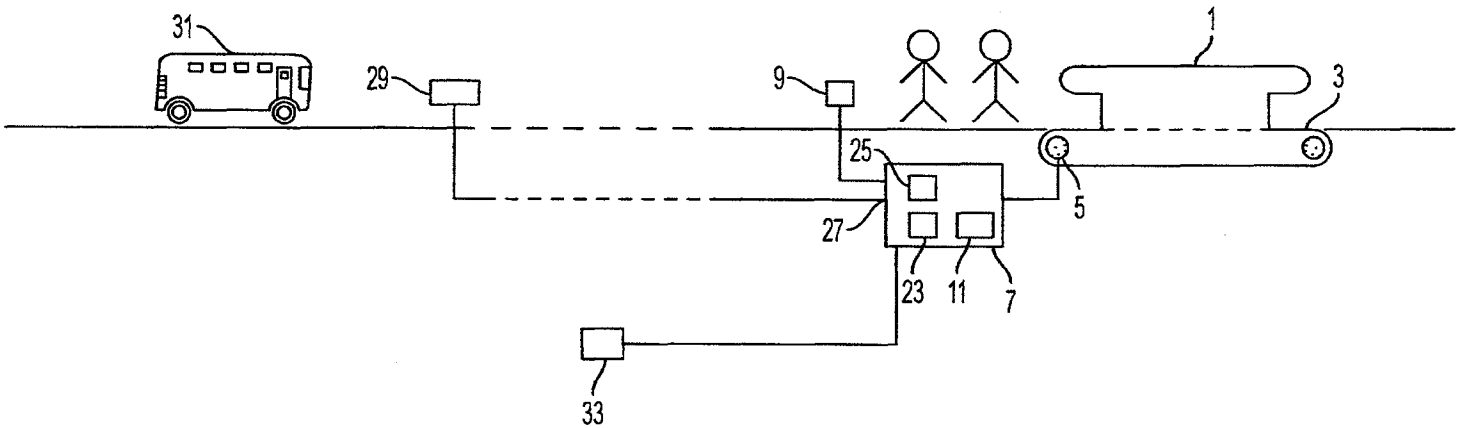
FIG. 1 shows a partial block diagram of an exemplary control arrangement in accordance with one embodiment of the invention.

FIG. 1 depicts an exemplary control arrangement in accordance with one embodiment. The control arrangement of a people mover 1 according to the invention comprises a movable conveyor track 3, on top of which people can be transported. The conveyor track 3 is formed from conveyor elements connected to each other into an endless loop. The people mover 1 also comprises a device 5 for moving the conveyor track 3, e.g. an electric motor. This device is arranged to be controlled automatically by a control 7 of the people mover, which control 7 comprises a device, e.g. an electronic control unit, for this purpose. The aforementioned people mover 1 may be a travelator, an escalator or a moving ramp. The conveyor elements are stair steps in an escalator and so-called pallets in a travelator or in a sliding ramp. In travelators a step does not essentially form between the consecutive pallets available to a passenger, because the transport surfaces of said pallets are essentially aligned. In an escalator the conveying elements available to a passenger comprise steps, the conveying surfaces of which are on a different level to each other. The following examples concentrate on an escalator, but the functions/features of the examples could be utilized in travelators and in ramps.

The conveyor track 3 of the people mover 1 is arranged to move under the control of the aforementioned control 7 at a first speed, which speed is a constant speed. The speed of the conveyor track of a people mover is arranged to be variable on the basis of passenger detections, more particularly to be decreasable if passengers are not detected at the time and have not been detected for a certain delay time. The changes can be arranged to be executed in one or more steps. The term first speed refers to the speed that the conveyor track has just before any decrease in speed whatsoever, and the term second speed refers to the speed that it has just after a decrease in speed. In other words, the variability of the delay time functions independently of whether the first or the second speed decrease step is the point in question.

The aforementioned first speed is, however, preferably the transport speed of passengers, which speed the people mover 1 has when passengers are traveling on it, preferably the rated speed of the people mover 1. The arrangement comprises passenger detection device 9, which device can be any device according to prior art, e.g. they can comprise a curtain-of-light, a radar sensor, an ultrasound sensor, a contact mat, a camera, et cetera, for detecting a passenger. The control 7 of the people mover is arranged to detect with the aforementioned passenger detection device 9 passengers, most preferably a person who is coming to the people mover 1, but alternatively, or additionally, they can detect a person who is being transported by the people mover 1 or a person leaving the people mover 1.

Figure 2:
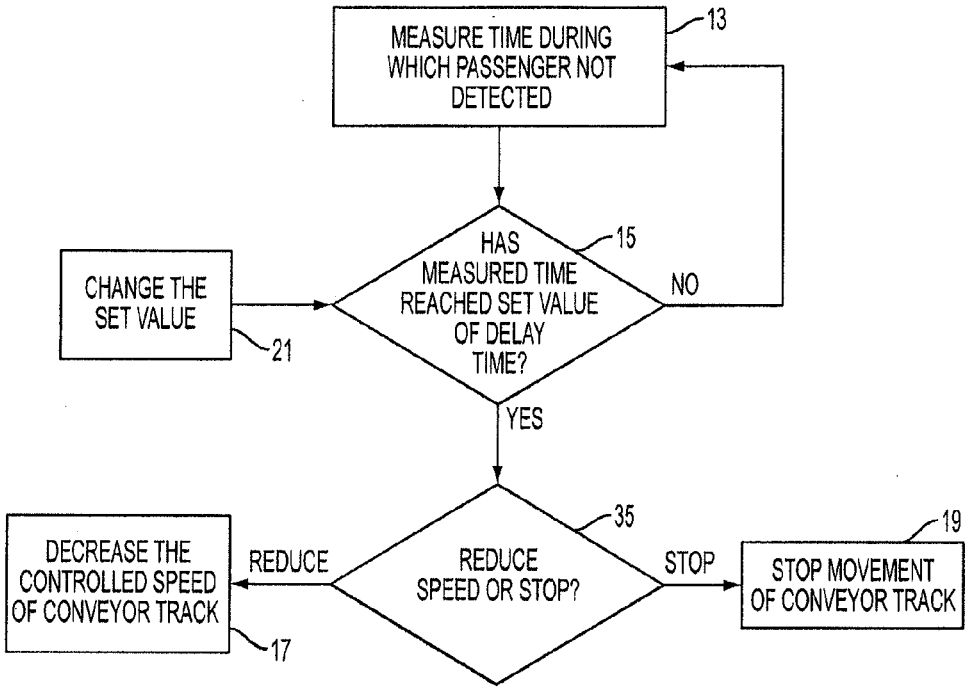
FIG. 2 depicts an exemplary process diagram in accordance with an embodiment of the invention.

FIG. 2 depicts an exemplary process diagram in accordance with one embodiment, and will be described in conjunction with FIG. 1. The arrangement additionally comprises a time-measuring device 11, which is most preferably a part of the aforementioned control 7, which time-measuring device 11 is arranged to measure the continuous time during which a passenger is not detected, preferably the time passed since the last detection of a passenger, as depicted in blocks 13 and 15 of FIG. 2. This can be achieved e.g. by always restarting the time measurement (e.g. a clock) when a passenger is detected with the aforementioned time measuring device 11. The control 7 is arranged to decrease the speed of the conveyor track 3 from the aforementioned first speed if the measured time reaches the set value of the delay time, as depicted in block 15 of FIG. 2, either to a lower second speed, as depicted in block 17 of FIG. 2, or to completely stop the movement, as depicted in block 19 of FIG. 2. In the control arrangement of a people mover 1 according to the invention the aforementioned set value of the delay time can be changed by an action of the control 7, as depicted in block 21 of FIG. 2. In this way the delay time can be configured to be very suitable to each situation automatically without shifting of the conveyor to the control panel and without using the control panel, and, in the best case, even completely without the scrutiny or other participation of a person. The set value of the delay time is preferably arranged to be changeable without removing the people mover from normal drive. In this case a set value can be changed despite possible movement of the conveyor track 3. The control is arranged to keep the conveyor track 3 moving regardless of the change in the set value, if the conveyor track 3 is moving at the time of the change. In this way therefore the people mover 1 can continue the run at the first speed without disturbance regardless of the changing of the set value. In the control arrangement of a people mover 1 according to the invention the set value of the delay time can preferably be automatically changed by an action of the control on the basis of some preset instruction, preferably on the basis of a point of time and/or on the basis of a signal coming from outside the people mover 1.

The set value of the delay time can therefore be arranged to change automatically on the basis of a point of time, for the purpose of which the arrangement, more particularly the aforementioned control 7, comprises a time determination device 23 for a point of time. The time determination device 23 of a point of time can in this case comprise a clock itself or correspondingly the time determination device 23 can receive data expressing a point of time (such as the time of day) from outside the control 7. In addition, the control 7 comprises a memory 25, in which set values for the points of time may be recorded. The control 7 is arranged to change the set value (actual to be compared to the time passed) of the delay time to be according to a (reference) set value recorded for the current point of time. Thus set values for different points of time may be recorded in the memory, from which points of time the set value recorded for the current point of time is taken as the set value of the delay time to be compared to the time that has passed. There are at least two, preferably even more, set values of different magnitudes, in which case situation-specific optimization is facilitated. When the time determination device 23 for the point of time are based on clock time, set values specific to the clock time of day are recorded in the memory 25. Preferably, there can be set values specific to the time of day for specific individual weekdays or calendar days. In this way the system can be arranged to take into account the time of day in a 24-hour period as well as the day of the week or a calendar day.

In practice, the aforementioned clock time is most preferably the time of a clock expressing the time of day, which clock is preferably a clock that counts a 24-hour cycle. Thus it is simple to record nighttime set values and daytime set values to be different. On the other hand, a clock can count a multiple of 24 hours, in which case the cycle is preferably 168 hours. In this case the clock in question is a weekly clock, in which case the set values for all the different moments of a week can be recorded in the memory for the specific clock time without separate setting of the current day of the week.

The aforementioned control 7 preferably comprises an input 27 for a signal external to the people mover 1, in which case a desired message can be sent to it by an action of the user or it can receive a signal from another automated system. Preferably connected to the aforementioned input 27 is an apparatus for determining 29 the position or information connected to the position of a public service vehicle 31, preferably of a train, that is in the proximity of the people mover 1, preferably for detecting a sensor at a station of the aforementioned public service vehicle (for detecting the arrival, presence at the station or departure of the train), or for receiving position data, or data connected to the position, of the public service vehicle of a data transfer channel connected to a system of a station of the aforementioned public service vehicle, from a system of a station of the public service vehicle.

Set values for points of time can be recorded in the memory 25 of the control 7, the set values being based, for example, on the timetables of public service vehicles that are in the proximity of the people mover 1. In this case the length of the delay time is arranged to change automatically on the basis of the timetable data of a public service vehicle 31 that is in the proximity of the people mover 1. The taking into account of the effect of the number of passengers of a public service vehicle 31 could alternatively be implemented such that the length of the delay time is arranged to change on the basis of a signal caused by a public service vehicle 31 that is in the proximity of the people mover 1, e.g. on the basis of an arrival signal in the proximity of the people mover 1.

For taking into account an external signal, the control 7 may be arranged to select the set value of the delay time on the basis of the aforementioned signal. The type of set value which the control 7 is arranged to select, if it receives the aforementioned signal, can in this case have been recorded in the memory 25. In parallel with this the arrangement can at the same time take into account the current point of time.

For the purpose of starting a change of a set value by an action of a user the arrangement can additionally comprise an interface 33 for sending a signal to the control 7, which interface 33 for sending a signal to the control 7 comprises e.g. a user interface in the control room of the people mover. In this way the operator can, e.g. give a command from a control room to the control based on his/her detections to change the set value of the delay time to be suitable, e.g. to be larger or smaller, such as, for instance, to the maximum or to the minimum.

The control 7 can additionally be arranged to itself record in memory 25 the aforementioned set values for points of time based on historical data. In this case the control 7 is so-called self-learning, for the purpose of which it comprises the commercially available electronic components needed. The control 7 may analyze the historical data of the passenger detection device 9, most preferably the traffic specific to the clock time, and selects or calculates set values of good magnitudes for the different points of time and records them in the memory 25. Preferably the control 7 here also takes into account signals that have come from outside during history. In this way the system can learn the significance, specific to the clock time, of a signal coming from outside to the traffic volume on the people mover 1 subsequent to the signal.

The aforementioned control arrangement of a people mover 1 can comprise at least one second people mover, which is a travelator, an escalator or a moving ramp, the conveyor track of which is arranged to move at a first speed (e.g. at a transporting speed when it is transporting passengers), and that the aforementioned control 7 is arranged to detect passengers of the aforementioned second people mover with second passenger detection device, and to measure the time passed since the last detection of a passenger of the second people mover with time measuring device, and after the measured time has reached the set value of the delay time of the second people mover, to decrease the speed of the conveyor track of the second people mover either to a lower second speed or to completely stop the movement, which set value of the delay time of the second people mover can be changed by an action of the aforementioned control 7. In this case the aforementioned control 7 may control more than one people mover in a corresponding manner. Set values for points of time are in this case recorded in the memory 25 comprised in the control 7, the set values being specific to the people mover 1. When the same control 7 can control a number of people movers, one advantage is that the controlling/monitoring of the set values by the action of a user becomes simpler.

The control 7 can be arranged to choose whether to decrease the speed of the conveyor track from a first speed to a lower second speed or whether to completely stop the movement of the conveyor track on the basis of certain instructions, as depicted in block 35 of FIG. 2. In this case it can choose whether to decrease the speed of the conveyor track 3 from a first speed to a lower second speed, as depicted in block 17 of FIG. 2, or whether to completely stop the movement of the, conveyor track, as depicted in block 19 of FIG. 2, on the basis of a point of time, and/or on the basis of a signal coming from outside the people mover 1, and/or on the basis of the learning logic of the system. In this way, after a delay, in certain situations the people mover 1 can be stopped directly without the speed entering creeping speed. For example, during a very quiet time, such as at night, there will often very probably be a long break between consecutive passengers or passenger groups. When the delay time has been selected to be very suitable, it is possible e.g. to keep the conveyor 3 on without a break during the transportation of a whole group remaining at a metro train station, after which the conveyor 3 is directly switched off, because it is very improbable that more passengers will appear after the whole group that came to the station.

The delay time of the aforementioned people mover 1, which is the delay time of the first and/or second speed decrease step (i.e. the delay time to execution of the first speed decrease and/or the delay time to execution of the second speed decrease), can be changed in the manner described above. In the above the aforementioned transport speed is the most preferred first speed, but alternatively it can therefore be an already decreased speed, i.e. a creeping speed, in which case the speed is always decreased from the creeping speed to a stopping state when the delay criteria are fulfilled in the manner specified above. Also a speed decrease to creeping speed could have been performed after a delay before this, said delay having been set in the manner defined by the delay criteria described in the preceding. When the case in point is a speed change step from an already decreased speed (from creeping speed) downwards, the arrangement is arranged to further decrease the speed of the conveyor track 3 of the people mover 1 or to completely stop the people mover 1, if the measured time during which a passenger has not been detected, e.g. the measured time from the last passenger, reaches the set value of the delay time without the passenger detection device 9 detecting a passenger, which delay time can be changed by an action of the control 7 in the manner stated above. When the case in point is a second speed change step in this manner, the aforementioned measuring of time from the last passenger can also be performed by letting the timekeeping continue. Alternatively, in connection with the decrease of the aforementioned speed to a second speed, the measuring of time can be arranged to start from the beginning, in which case the reference set values recorded in the memory 25 are selected taking into account the adjustment to zero occurring at the moment of speed decrease.

After the aforementioned decrease of speed or stopping, the arrangement is arranged to increase the speed of the conveyor track 3 if a passenger coming to the people mover 1 is detected with the aforementioned passenger detection device 9 (i.e. the control detects said passenger).

The device for determining a point of time could be of a different type to those presented above, such as e.g. a measuring arrangement of luminosity for determining the time of day, et cetera. The point of time, on the other hand, could be another because it can be a day of the week, a season of the year, a month or a date.

The set values can most preferably be recorded in the memory 25 in table format. When tabulated by points of time, a table can comprise a number of fields for each point of time if other criteria than a point of time (e.g. an external signal) are in use. Alternatively, the set values can be recorded in the memory 25 in graph format. If in this case other criteria are in use, they can result in the bypassing of a set value of the curve or in a preset change in the set value indicated by the curve for the current moment. As stated above, the set values are of different magnitudes. It is, however, obvious that there does not need to be a set value of a unique specific magnitude for each situation or clock time, but instead there can be a limited plurality of set values of different magnitudes and for each situation the most suitable of them is set/can be set.

Changing of the actual set value of the delay time, to which the time passed is arranged to be compared, can be performed e.g. by recording in the memory 25 a new value as the value for the delay time, which new value is selected from the aforementioned set values according to a predefined instruction.

It is obvious to the person skilled in the art that the invention is not limited to the embodiments described above, in which the invention is described using examples, but that many adaptations and different embodiments of the invention are possible within the frameworks of the inventive concept defined by the claims presented below.

The invention claimed is:

1. A control arrangement for controlling a people mover, comprising:

a movable conveyor track for transporting people on the conveyor track at a controlled speed;

a passenger detection device to detect passengers of the people mover; and a control unit coupled to an output of the passenger detection device and adapted to measure a time during which a passenger is not detected, and after the measured time has reached a set value of a delay time, to decrease the controlled speed of the conveyor track of the people mover from a first speed to a lower second speed or to completely stop movement of the conveyor track, wherein the set value of the delay time is changeable by an action of the control unit.

2. The control arrangement according to claim 1, wherein the set value of the delay time is changeable without removing the people mover from operation.

3. The control arrangement according to claim 1, wherein the control unit is adapted to change the set value of the delay time on the basis of one of a point of time and of a signal coming from outside the people mover.

4. The control arrangement according to claim 1, wherein the control unit comprises a time determination device to determine the point of time.

5. The Control arrangement according to claim 1, wherein the control unit comprises a memory to record set values of different magnitudes for the points of time.

6. The control arrangement according to claim 5, wherein the control unit is arranged to record in the memory the set values for points of time based on historical data at least of the detections of the passenger detection device and on signals coming from outside.

7. The control arrangement according to claim 1, wherein the control unit is arranged to change the set value of the delay time according to a set value recorded for a current point of time.

8. The control arrangement according claim 1, wherein set values specific to a time of day are recorded in the memory.

9. The control arrangement according to claim 1, wherein set values of different magnitudes for points of time are recorded in the memory, said set values being based on timetables of public service vehicles that are in proximity of the people mover.

10. The control arrangement according to claim 1, wherein the control unit is arranged to change the aforementioned set value of the delay time on the basis of a point of time corresponding to a clock time of day.

11. The control arrangement according to claim 1, wherein set values specific to a time of day are recorded, or are recordable, in the memory for specific individual weekdays or calendar days.

12. The control arrangement according to claim 1, wherein the control unit is arranged to change the set value of the delay time on the basis of a signal caused by a public service vehicle that is in proximity of the people mover.

13. The control arrangement according to claim 1, wherein the control unit comprises an input for a signal external to the people mover, and a memory, in which set values are recorded, and in that the control is arranged to select the set value of the delay time on the basis of the aforementioned signal.

14. The control arrangement according to claim 1, further comprising a user interface to send a signal to the control unit.

15. The control arrangement according to claim 13, further comprising position determining apparatus connected to the input of the control unit for determining a position or information related to a position of a public service vehicle that is in proximity of the people mover.

16. The control arrangement according to claim 15, wherein the positioning determining apparatus comprises one of a sensor at a station of the public service vehicle, or a data transfer channel connected to a system of the station of the public service vehicle, for receiving position data or data related to the position of the public service vehicle from the system of the station of the public service vehicle.

17. The control arrangement according to claim 1, wherein the control is arranged to choose whether to decrease the speed of the conveyor track from a first speed to a lower second speed or whether to completely stop the movement of the conveyor track on the basis of at least one of a point of time and a signal coming from outside the people mover.

* * * * *